US008094093B2

(12) United States Patent
Sasaki et al.

(10) Patent No.: US 8,094,093 B2
(45) Date of Patent: Jan. 10, 2012

(54) PLASMA DISPLAY APPARATUS

(75) Inventors: Takashi Sasaki, Kawasaki (JP); Yuichiro Kimura, Kawasaki (JP); Yasunobu Hashimoto, Kawasaki (JP); Keizo Suzuki, Kodaira (JP); Kenichi Yamamoto, Higashimurayama (JP)

(73) Assignees: Hitachi Plasma Display Limited, Miyazaki (JP); Hitachi Plasma Patent Licensing Co., Ltd., Tokyo (JP)

( * ) Notice: Subject to any disclaimer, the term of this patent is extended or adjusted under 35 U.S.C. 154(b) by 841 days.

(21) Appl. No.: 12/175,418

(22) Filed: Jul. 17, 2008

(65) Prior Publication Data

US 2008/0278417 A1 Nov. 13, 2008

Related U.S. Application Data

(63) Continuation of application No. 11/071,346, filed on Mar. 4, 2005, now abandoned.

(30) Foreign Application Priority Data

Mar. 24, 2004 (JP) ..... 2004-086936

(51) Int. Cl.
*G09G 3/28* (2006.01)

(52) U.S. Cl. ..... 345/63; 315/169.4

(58) Field of Classification Search ..... 345/60–72, 345/204, 692; 315/169.4
See application file for complete search history.

(56) References Cited

U.S. PATENT DOCUMENTS 4,349,819 A 9/1982 Terakawa
5,642,018 A 6/1997 Marcotte
6,011,355 A 1/2000 Nagai
6,100,859 A 8/2000 Kuriyama et al.
6,175,192 B1 1/2001 Moon
6,426,732 B1 7/2002 Makino
6,653,993 B1 11/2003 Nagao et al.
6,686,698 B2 2/2004 Takeuchi et al.
6,724,356 B1 4/2004 Kojima et al.
6,784,857 B1 8/2004 Nakamura
6,853,358 B2 2/2005 Kunii et al.
6,891,519 B2 5/2005 Ooe et al.

(Continued)

FOREIGN PATENT DOCUMENTS

CN 1444198 9/2003

(Continued)

OTHER PUBLICATIONS

U.S. Appl. No. 11/071,346, filed Mar. 4, 2005, Takashi Sasaki, et al.

*Primary Examiner* — Stephen Sherman
(74) *Attorney, Agent, or Firm* — Staas & Halsey LLP

(57) ABSTRACT

A AC type plasma display apparatus has been disclosed, which satisfies various requirements such as the number of gradations that can be displayed, the display luminance, and the upper limit of power and, further, the efficiency of light emission and the luminance can be increased as much as possible and the display quality of which is not deteriorated. In the plasma display apparatus, a frame is composed of plural subfields, an image is displayed by causing a sustain discharge to occur in each subfield, the sustain discharge can be caused to occur by at least a first sustain waveform and a second sustain waveform different from the first sustain waveform, and the ratio of the first sustain waveform to the second sustain waveform changes, both waveforms being used to cause the sustain discharge to occur in each subfield.

6 Claims, 14 Drawing Sheets

U.S. PATENT DOCUMENTS

| | | | |
|---|---|---|---|
| 6,900,781 | B1 | 5/2005 | Mori et al. |
| 6,933,911 | B2 | 8/2005 | Suzuki |
| 7,023,405 | B2 | 4/2006 | Awamoto et al. |
| 2001/0005188 | A1 | 6/2001 | Watanabe |
| 2002/0008678 | A1 | 1/2002 | Rutherford |
| 2002/0054001 | A1 | 5/2002 | Awamoto |
| 2003/0179162 | A1 | 9/2003 | Ooe et al. |
| 2004/0021622 | A1 | 2/2004 | Nagao et al. |
| 2004/0201553 | A1 | 10/2004 | Itokawa et al. |
| 2004/0233131 | A1 | 11/2004 | Kang et al. |
| 2005/0013238 | A1 | 1/2005 | Hansen |
| 2005/0073476 | A1 | 4/2005 | Takagi et al. |

FOREIGN PATENT DOCUMENTS

| | | |
|---|---|---|
| CN | 1445740 | 10/2003 |
| CN | 1469335 | 1/2004 |
| JP | 6-4039 | 1/1994 |
| JP | 7-134565 | 5/1995 |
| JP | 10-177363 | 6/1998 |
| JP | 11-282416 | 10/1999 |
| JP | 2001-5423 | 1/2001 |
| JP | 2001-13913 | 1/2001 |
| JP | 2001-34227 | 2/2001 |
| JP | 2001-228820 | 8/2001 |
| JP | 2002-189443 | 7/2002 |
| JP | 2002-311887 | 10/2002 |
| KR | 2002-0061913 | 7/2002 |

PLASMA DISPLAY APPARATUS

CROSS-REFERENCE TO RELATED APPLICATIONS

This application is a Continuation application of application Ser. No. 11/071,346, filed Mar. 4, 2005 now abandoned, and claims priority benefit of Japanese application No. 2004-086936, filed Mar. 24, 2004, the contents of all of which being incorporated herein by reference.

BACKGROUND OF THE INVENTION

1. Field of the Invention

The present invention relates to a plasma display apparatus (a PDP apparatus) used as a display unit for a personal computer or workstation, a flat TV, or a plasma display for displaying advertisements, information, etc.

As an AC type color PDP apparatus, an address/display separate system, in which a period (an address period) during which cells to be displayed are selected and a display period (a sustain period) during which a discharge is caused to occur for display lighting are separated, is widely employed. In this system, during the address period, charges are accumulated in a cell to be lit and, during the sustain period, a sustain discharge is caused to occur repeatedly for a display using the charges.

In the PDP apparatus, only two states, that is, a lit state and an unlit state, are selected for a display and gray levels cannot be expressed by adjusting the strength of discharge. Therefore, in the PDP apparatus, a display frame is composed of plural subfields and gray levels are expressed by combining subfields to be lit for each display cell.

FIG. 1A and FIG. 1B are diagrams showing an example of a conventional subfield configuration. As shown in FIG. 1A, one frame is composed of n subfields SF1 to SFn. Each subfield has a reset period R during which the display cells are put into the same state, an address period A during which display cells to be lit or not lit are selected, and a sustain period S during which a sustain discharge is caused to occur in the display cells to be lit to produce a display. Generally, the luminance of each subfield is in proportion to the number of sustain discharges during the sustain period S and the number of sustain discharges, that is, the luminance, in each subfield is set in a predetermined ratio. For example, a configuration in which the ratio of luminance of each of the subfields SF1 to SFn is set in 1:2:4: , , , :$2^n$, that is, the ratio of a member to its previous member is 2, is widely known, but other various ratios have also been proposed.

In the conventional PDP apparatus, there is only one kind of sustain pulse for causing a sustain discharge to occur and a sustain pulse having the same waveform is used in each subfield. In other words, the period of the sustain pulse is constant. Therefore, in a subfield having a different luminance weight, the length of the sustain period S is different. The efficiency of light emission and the luminance by one pulse differ in accordance with the waveform (the sustain waveform) and the period of a sustain pulse. On the other hand, the number of sustain pulses in each subfield (one frame) affects the possible number of gradations that can be displayed and the display luminance. Because of this, these factors being taken into consideration in total, the sustain waveform, the subfield configuration, and the number of sustain pulses in each field, are determined.

In the PDP apparatus, on the other hand, the upper limit of power is set in relation to the amount of heat to be produced and the rated current. The power consumed in one frame relates to the total number of sustain discharges caused to occur in one frame. Specifically, the total number is obtained by summing the number of cells to be lit in each subfield multiplied by the number of sustain pulses in the subfield in all the subfields. Therefore, when an entirely bright display is produced, the power increases, and when an entirely dark display is produced, the power decreases. The brightness of a display of the entire one frame is referred to as the display load ratio and can be expressed by, for example, the total of the display gradations of the entire display cell in one frame. When a frame having a large display load ratio is displayed, the power increases and a frame having a small display load ratio is displayed, the power decreases.

As described above, although a subfield configuration is determined by taking into consideration the number of gradations that can be displayed and the display luminance, the upper limit of the power needs to be considered. In order to prevent the power from exceeding the upper limit even when an entirely bright display is produced, the number of sustain pulses in one frame must be set to a small value but this causes a problem in that the number of gradations that can be displayed and the display luminance are reduced. Generally, the frequency of occurrence of an entirely bright display is low and the frequency of a continuous occurrence thereof is even lower. Therefore, a control is carried out, in which the number of sustain pulses in each subfield is changed, so that a display as bright as possible can be produced while the luminance ratio among subfields is maintained and the power is prevented from exceeding the upper limit in accordance with the display load ratio. This control is called the sustain number control or the power control.

FIG. 2A to FIG. 2C are diagrams for explaining a conventional power control. FIG. 2A shows a relationship between display load ratio and luminance (luminance when the highest level is displayed in each cell), FIG. 2B shows a relationship between display load ratio and the number of sustain pulses, and FIG. 2C shows a relationship between display load ratio and power. In the domain where the display load ratio is less than P1, the power is equal to or less than the predetermined upper limit, therefore, the number of sustain pulses is kept to a constant value as shown in FIG. 2B (B1-B2). In this domain, as the display load ratio increases, the current of the sustain discharge increases in the circuit and panel, the luminance decreases gradually because of a drop in voltage (A1-A2), and the power increases (C1-C2). In the domain where the display load ratio is greater than P1, the power control (the sustain number control) is carried out because the power exceeds the predetermined value otherwise. In this control, the number of sustain pulses is decreased in accordance with the display load ratio as shown in FIG. 2B (B2-B3) and the power is kept to the predetermined value as shown in FIG. 2C (C2-C3). As the number of sustain pulses decreases, the luminance also decreases in accordance with the display load ratio as shown in FIG. 2A.

FIG. 1A shows the subfield configuration in the domain where the display load ratio is less than P1 in FIG. 2A to FIG. 2C. When the number of sustain pulses decreases in the domain where the display load ratio is greater than P1, the number of sustain pulses in each subfield decreases. At this time, the number of sustain pulses is decreased in each subfield in order to maintain the luminance ratio. As described above, there is only one kind of sustain pulse and the period thereof is constant and, therefore, if the number of sustain pulses decreases, the length of the sustain period S in each subfield is shortened. As a result, a rest period during which no action is taken is produced in a frame and the length of the rest period increases as the display load ratio increases.

As described above, only one kind of sustain pulse is used usually, but the use of a sustain pulse having a different period is also proposed. For example, Japanese Unexamined Patent Publication (Kokai) No. 2001-228820 has disclosed a configuration in which a unit is made by combining a pulse having a short period and a narrow width and a pulse having a long period and a wide width, and a sustain pulse is repeated in this unit in each subfield. However, in the configuration described in this document, the ratio of the number of sustain pulses having a long period to that of sustain pulses having a short period is fixed. Moreover, this document does not refer to a power control or the difference in the luminance or in the efficiency of light emission due to the difference in the period of the sustain pulse.

U.S. Pat. No. 6,686,698 has described a configuration in which the display load ratio is detected for each subfield, the period of a sustain pulse in a subfield with a small display load ratio is shortened, and the number of sustain pulse is increased to increase the luminance by redistributing the time produced by the shortening to all the subfields. This configuration, however, causes a problem in that the redistribution of the time obtained by the shortening is necessary and therefore the process is complex. Moreover, this document does not refer to the difference in the luminance or in the efficiency of light emission due to the difference in the period of the sustain pulse.

SUMMARY OF THE INVENTION

As described above, the sustain waveform, the subfield configuration, and the number of sustain pulses in each subfield are determined by taking into consideration the number of gradations that can be displayed, the display luminance, the upper limit of the power, etc., and the power control is further carried out. There is only one kind of sustain waveform and when the number of sustain pulses decreases because of the power control, a rest period is produced. If a rest period is produced, the center of light emission in a frame shifts to one side and a problem is caused in that the flickers are increased in number.

Although the sustain waveform is determined by taking various factors into consideration as described above, the efficiency of light emission can be increased by lengthening the period of the sustain pulse thus determined and there is another sustain waveform that increases the luminance per sustain discharge even though the pulse has the same voltage. It is obvious that, in the configuration as shown in FIG. 1A, the period of a sustain pulse cannot be lengthened, but in a state in which a rest period is produced as shown in FIG. 1B, it may be expected that the efficiency of light emission and the luminance are increased by using a sustain pulse having a long period. In other words, the production of a rest period means that an optimum sustain waveform is not used. However, each subfield is required to maintain a luminance ratio and if the change in luminance due to the change in sustain waveform is large, the continuity of the luminance between display gradations is lost and a problem of degradation of display quality is caused.

An object of the present invention is to realize a plasma display apparatus in which the efficiency of light emission and the luminance are increased as much as possible and the display quality is not degraded while various requirements such as the required number of gradations that can be displayed, the display luminance, and the upper limit of the power are satisfied.

In order to realize the above-mentioned object, in a plasma display apparatus according to a first aspect of the present invention, at least two different sustain waveforms are made available and the ratio of the number of respective sustain waveforms to be used in each subfield is varied.

For example, the sustain pulse having the first sustain waveform and the sustain pulse having the second sustain waveform cause respective sustain discharges to occur, the luminance or the efficiency of light emission of which is different and, for example, the second sustain waveform has a period longer than that of the first sustain waveform.

When the display load ratio is large, a power control is carried out in order to reduce the number of sustain pulses so that the power is equal to or less than a predetermined value and the proportion of the second sustain waveform is increased in accordance with a rest period produced by the reduction in the number of sustain pulses. At this time, it is necessary for the luminance ratio among subfields to be maintained and for the luminance of gradated displays to be continuous even if the proportion of the second sustain waveform is increased.

For example, it is assumed that the second sustain waveform has a period three times the period of the first sustain waveform and a luminance 1.3 times the luminance thereof. First, the rest period is divided by the difference in period between the second sustain waveform and the first sustain waveform (in the present embodiment, twice that of the first sustain waveform) in order to calculate the number of sustain pulses that can be replaced with the second sustain waveform (the number of replaced pulses). A value obtained by subtracting the number of replaced pulses from the number of sustain pulses in a frame (the total number of sustain pulses) is the number of pulses having the first sustain waveform (the number of remaining pulses). Next, the luminance is found and the luminance to be allocated to each subfield is found in accordance with the luminance ratio. The second sustain pulses are distributed to each subfield so that the difference between the luminance thus allocated to each subfield and the luminance after the pulses are actually replaced, is as small as possible. Specifically, when the members of the luminance ratio among eight subfields are 1, 2, 4, 8, 16, 32, 64, and 128, that is, the total luminance is 256, and if the number of first sustain pulses decreases by six, the number of replaced pulses is 6/2, that is, three. Therefore, the total luminance value is $256-3+3\times1.3=256.9$. If this total luminance value is distributed without changing the luminance ratio, the members are approximately 1, 2, 4, 8, 16.1, 32.1, 64.2, and 128.5. If three pulses to be replaced are distributed so that the ratio is most approximate to the above-mentioned ratio, two of the pulses are distributed to the subfield having a member of 128 and one of the pulses is distributed to the subfield having a member of 64 and, as a result, the members in the luminance ratio are 1, 2, 4, 8, 16, 32, 64.3, and 128.6 and the difference between luminance ratios can be reduced. It is preferable to perform this replacement all together at the rear part in each subfield. By replacing the first sustain waveform with the second sustain waveform as described above, the power control is carried out so as to increase the luminance while the luminance ratio among subfields is maintained, the continuity of gradations is not lost by replacement, and a rest period is not produced.

Therefore, the ratio of the first sustain waveform to the second sustain waveform is changed in each subfield independently of each other. When the display load ratio is low, only the first sustain waveform is applied, therefore, the proportion of the second sustain waveform is 0% and as the display load ratio exceeds a predetermined value, the proportion gradually increases. In the example described above, when the total of the sustain periods in one frame is one third of the initial value, the proportion of the second sustain waveform reaches 100%, that is, only the second sustain waveform is applied. When the display load ratio increases further, the number of sustain pulses having the second sustain waveform further decreases, therefore, a rest period is produced. It is also possible to use third and fourth sustain waveforms (having a longer period) different from the first and second sustain waveforms and when a rest period is produced in a state in which only the second sustain waveform is applied, part of the third and fourth sustain waveforms having a period longer than that of the second sustain waveform can also be used.

A circuit to detect the display load ratio is provided and the above-mentioned control is carried out in accordance with the detection result. This circuit can perform calculation by adding the gray level in each cell in display data.

It is also possible for the second sustain waveform to not only have a period longer than that of the first sustain waveform but have a different waveform. The first sustain pulse waveform is a rectangular pulse waveform because the period is short but as the period of the second sustain waveform is long, it is possible to increase the efficiency of light emission by changing the waveform. For example, a waveform that causes a sustain discharge to occur twice in one polarity change, or a waveform that applies a high voltage in a short time and then maintains a state in which a voltage slightly lower than a high voltage is applied in one polarity change are available.

Although the control according to the first aspect of the present invention is described above, in which the ratio of the first sustain waveform to the second sustain waveform is varied gradually in each field independently of each other, such a control requires a processing circuit that is complex and has high operation processing performance. A second aspect of the present invention relates to a plasma display apparatus that carries out simpler control.

A plasma display apparatus according to the second aspect of the present invention is an AC type plasma display apparatus, in which one frame is made up of a plurality of subfields and an image is displayed by causing a sustain discharge to occur in each subfield, and which is capable of causing a sustain discharge to occur by a first sustain waveform and a second sustain waveform different from the first sustain waveform and generating a sustain discharge with a high luminance or a high degree of efficiency of light emission, and in which, when the luminance of a display when a sustain discharge, caused to occur by using only the first sustain waveforms, is substantially the same as that when a sustain discharge is caused to occur by using only the maximum number of second sustain waveforms available under the conditions of drive time, the first sustain waveforms are replaced with the second sustain waveforms.

According to the present invention, the efficiency of light emission can be improved when the display load ratio increases and a display of high luminance and high quality can be produced in an AC type plasma display apparatus that carries out a power control.

BRIEF DESCRIPTION OF THE DRAWINGS

The features and advantages of the invention will be more clearly understood from the following description taken in conjunction with the accompanying drawings, in which.

DESCRIPTION OF THE PREFERRED EMBODIMENTS

The first embodiment of the present invention is an embodiment in which the present invention is applied to an ALIS system PDP apparatus disclosed in U.S. Pat. No. 6,373,452. As the ALIS system is disclosed in this document, a detail explanation is not given here.

Figure 3:
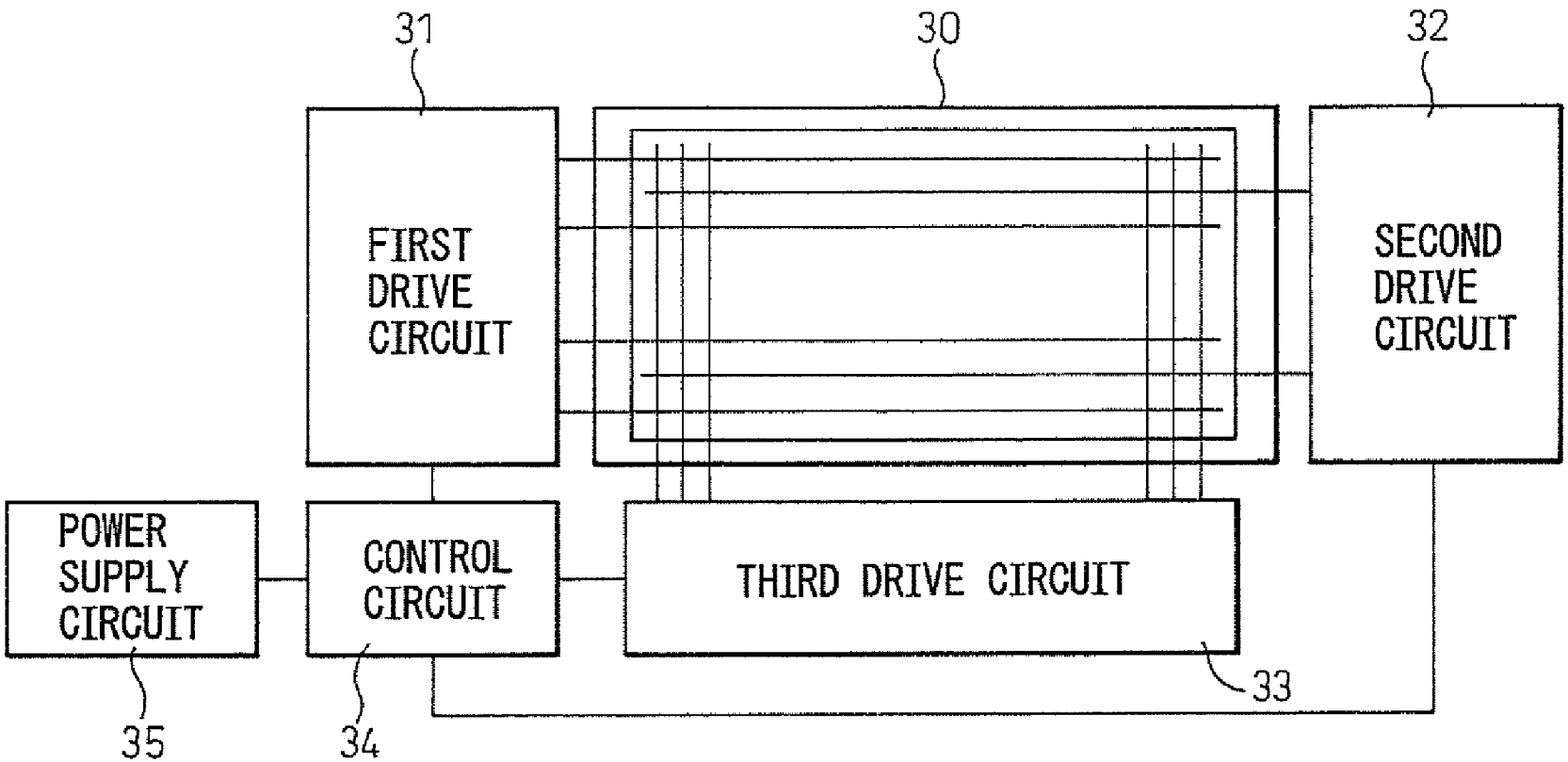
FIG. 3 is a diagram showing the general configuration of a PDP apparatus in a first embodiment of the present invention.

FIG. 3 is a diagram showing the general configuration of the plasma display apparatus (PDP apparatus) in the first embodiment of the present invention. As shown schematically, a plasma display panel 30 has a group of first electrodes (X electrodes) and a group of second electrodes (Y electrodes) extending in the transverse direction (lengthwise direction) and a group of third electrodes (address electrodes) extending in the longitudinal direction. The X electrodes and the Y electrodes are arranged by turns and the number of X electrodes is one more than the number of Y electrodes. The X electrodes are connected to a first drive circuit 31, being divided into a group of odd-numbered X electrodes and a group of even-numbered X electrodes, and both groups are driven commonly. The Y electrodes are connected to a second drive circuit 32 and a scan pulse is applied sequentially to each Y electrode and the Y electrodes are divided into a group of odd-numbered Y electrodes and a group of even-numbered Y electrodes and both groups are driven commonly except when a scan pulse is applied. The address electrodes are connected to a third drive circuit 33 and an address pulse is applied thereto in synchronization with a scan pulse. The first to third drive circuits 31 to 33 are controlled by a control circuit 34 and power is supplied to each circuit from a power supply circuit 35.

Figure 4:
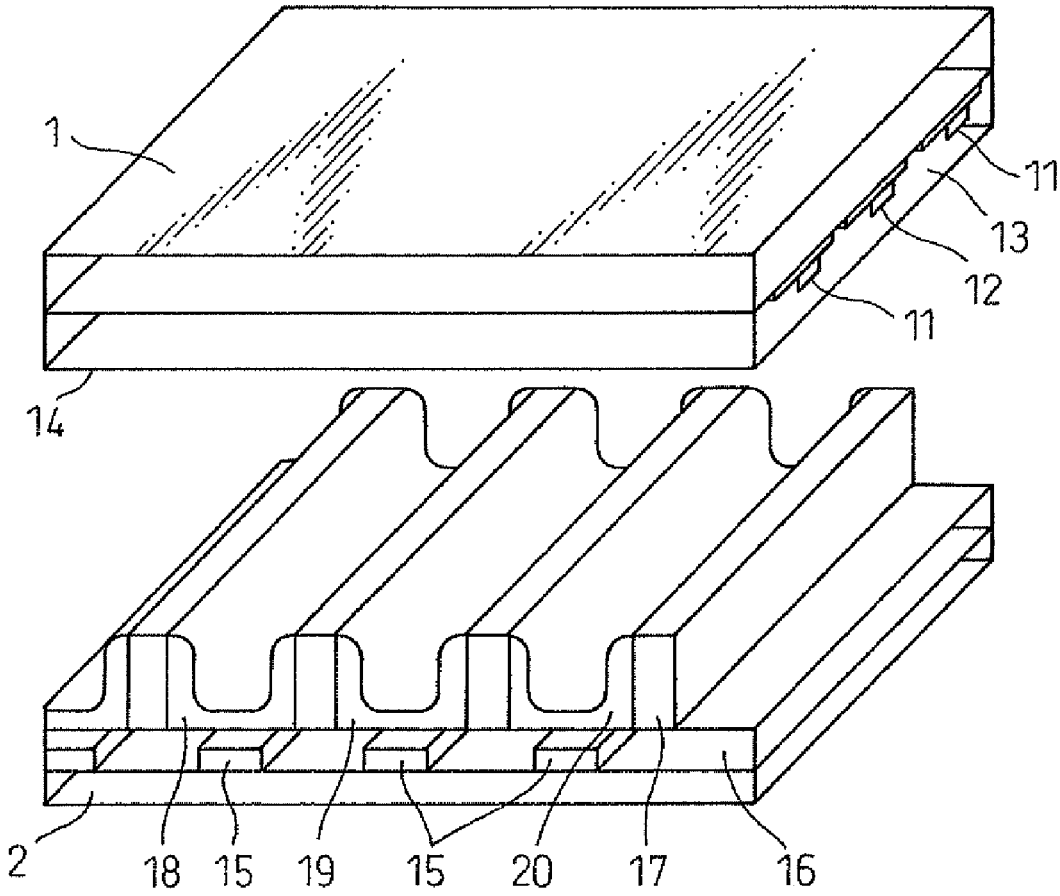
FIG. 4 is a perspective exploded view of the PDP in the first embodiment.

FIG. 4 is a perspective exploded view of the plasma display panel (PDP) 30. As shown schematically, on a front (first) glass substrate 1, sustain (X) electrodes 11 and scan (Y) electrodes extending in the transverse direction are alternately arranged in parallel to each other. The X electrodes 11 and the Y electrodes 12 are covered with a dielectric layer 13 and the surface thereof is further covered with a protective layer 14 such as MgO. On a back substrate 2, address electrodes 15 extending in the direction substantially perpendicular to the X electrodes 11 and the Y electrodes 12 and the address electrodes 15 are covered with a dielectric layer 16. On both sides of the address electrode 15, partition walls 17 are arranged to define cells in the direction of the columns. Further, phosphors 18, 19, and 20, which are excited by ultraviolet rays and generate visible light in red (R), green (G), and blue (B), respectively, are applied onto the dielectric layer 16 on the address electrode 15 and the sides of the partition wall 17. The front substrate 1 and the back substrate 2 are bonded to each other in such a manner that the protective layer 14 and the partition walls 17 come into contact with each other, discharge gases such as Ne or Xe are sealed therein, and thus the panel is configured.

In this structure, the Y electrode 12 selectively causes a sustain discharge to occur between itself and the X electrode 11 located on one side of the Y electrode 12 in an odd subfield and selectively causes a sustain discharge to occur between itself and the X electrode 11 located on the other side in an even subfield. Therefore, the ALIS system PDP apparatus shown in FIG. 3 and FIG. 4 produces an interlaced display and a display line is formed in every space between the X electrode 11 and the Y electrode 12.

Figures 5A, 5B, 5C, 5D:
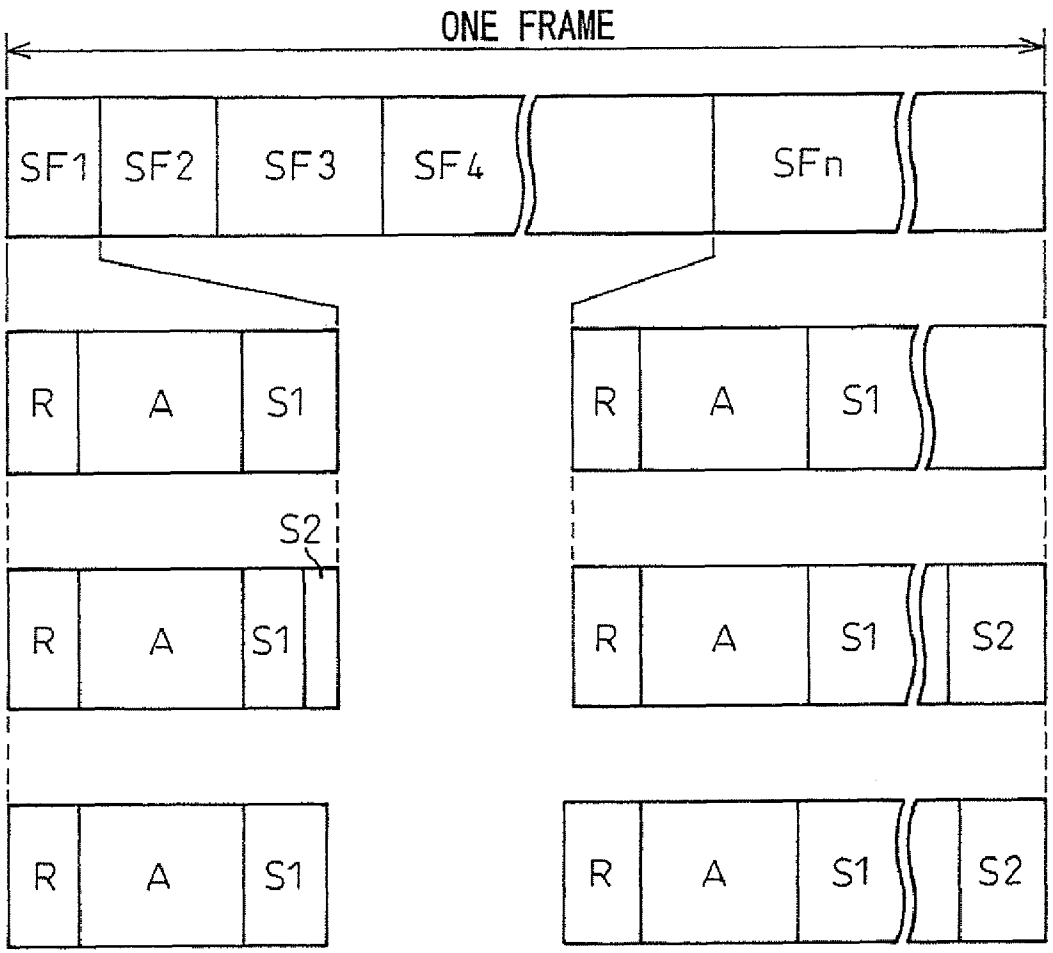
FIG. 5A to FIG. 5D are diagrams for explaining a subfield configuration in the first embodiment.

FIG. 5A is a diagram showing the subfield configuration of the PDP apparatus in the first embodiment and FIG. 5B to FIG. 5D show the changes in a period S1 during which the first sustain waveform is used and in a period S2 during which the second sustain waveform is used in a sustain period S in SF1 and SFn. In other words, in the first embodiment, the sustain period S in each subfield is made up of the period S1 during which the first sustain waveform is used and the period S2 during which the second sustain waveform is used, and the proportion of the period S2 varies in the range between 0% and 100%.

FIG. 5B shows a state in which only the first sustain waveform is used in each subfield. FIG. 5C shows a state in which both the first sustain waveform and the second sustain waveform are used in each subfield. FIG. 5D shows a state in which both the first sustain waveform and the second sustain waveform are used in some subfields including SFn but only the first sustain waveform is used in other subfields including SF1. It may be possible that the subfield in which only the first sustain waveform is used is not SF1. Although not shown schematically, there may be a state in which only the second sustain waveform is used in each subfield.

As described above, the PDP apparatus in the present embodiment employs the ALIS system and a display line is formed in every space between the X electrode and the Y electrode. For example, a first display line is formed between the first X electrode and the first Y electrode, a second display line is formed between the first Y electrode and the second X electrode, a third display line is formed between the second X electrode and the second Y electrode, and a fourth display line is formed between the second Y electrode and the third X electrode. In other words, an odd-numbered display line is formed between an odd-numbered X electrode and a Y electrode and between an even-numbered X electrode and a Y electrode, and an even-numbered display line is formed between an odd-numbered Y electrode and an even-numbered X electrode and between an even-numbered Y electrode and an odd-numbered X electrode. One display field is divided into an odd field and an even field and, in the odd field, odd-numbered display lines are displayed and in the even field, even-numbered display lines are displayed. The odd field and the even field are composed of plural subfields, respectively.

Figure 6:
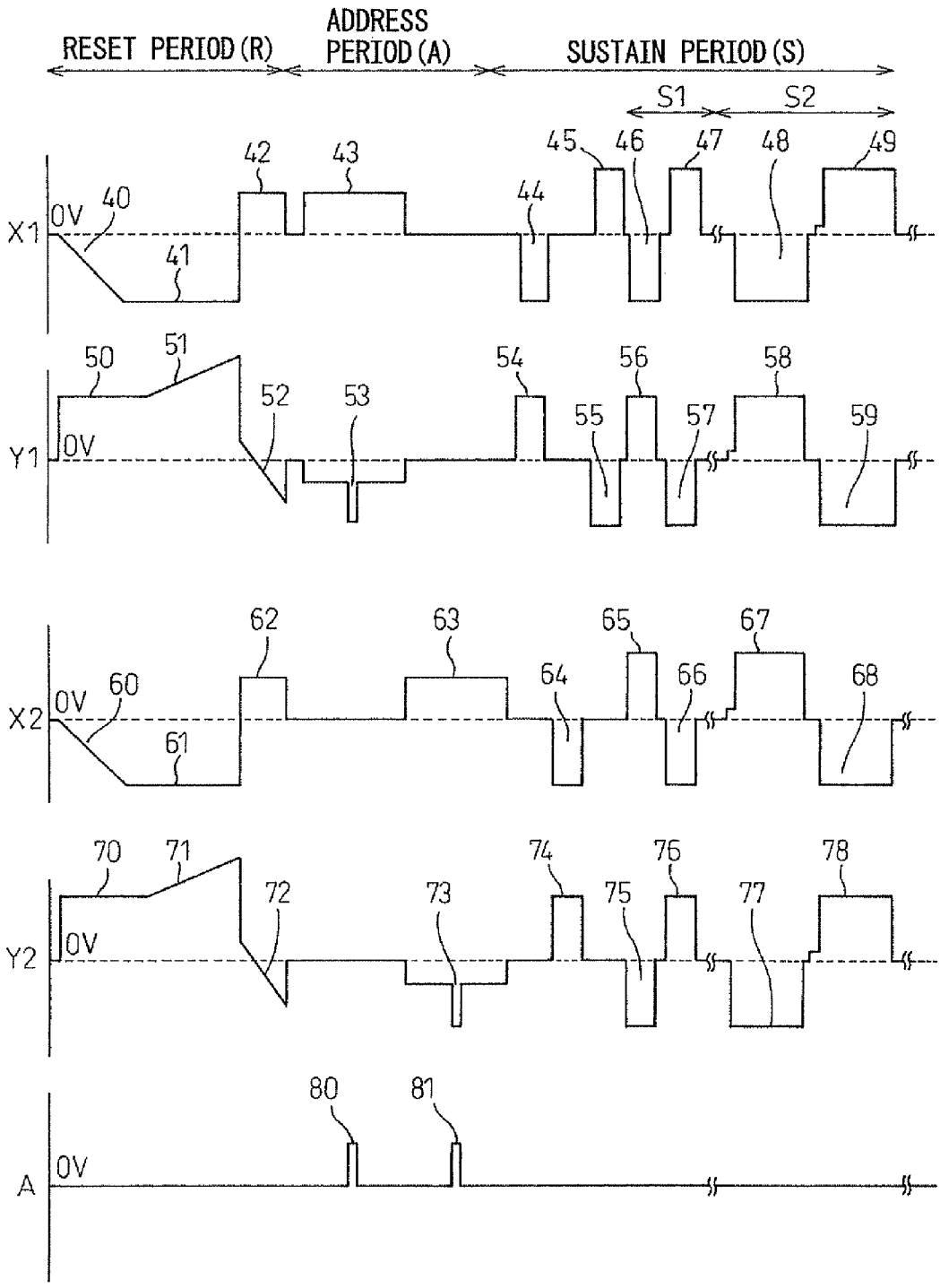
FIG. 6 is a diagram showing drive waveforms of the PDP apparatus in the first embodiment.

FIG. 6 is a diagram showing drive waveforms in one subfield in the odd field in the PDP apparatus in the present embodiment, to be applied to the odd-numbered X electrode (X1), the odd-numbered Y electrode (Y1), the even-numbered X electrode (X2), the even-numbered Y electrode (Y2), and the address electrode (A), respectively.

The drive waveform to be applied to the X1 electrode is composed of an X erasure wave 40, a voltage of which changes gradually, for erasing wall charges formed in the vicinity of the electrode by the immediately previous sustain discharge, an X voltage 41 for forming wall charges in all the cells by repeatedly causing a slight discharge to occur in the cells, an X compensation voltage 42 for adjusting the quantity of residual wall charges, a selection voltage 43 for selecting display lines, and sustain pulses 44 to 49.

The drive waveform to be applied to the Y1 electrode is composed of a Y erasure voltage 50 for erasing wall charges formed in the vicinity of the electrode by the immediately previous sustain discharge, a Y write wave 51, a voltage of which changes gradually, for forming wall charges in all the cells by repeatedly causing a slight discharge to occur in the cells, a Y compensation wave 52, a voltage of which changes gradually, for adjusting the quantity of residual wall charges, a scan pulse 53 for electing cells to be lit, and sustain pulses 54 to 59.

Similarly, the drive waveform to be applied to the X2 electrode is composed of an X erasure dull wave 60, an X voltage 61, an X compensation voltage 62, a selection voltage 63, and sustain pulses 64 to 68. The drive waveform to be applied to the Y2 electrode is composed of a Y erasure voltage 70, a Y write dull wave 71, a Y compensation dull wave 72, a scan pulse 73, and sustain pulses 74 to 78.

The drive waveform to be applied to the address electrode A is composed of address pulses 80 and 81.

The scan pulses 53 and 73 are applied with sequentially shifted timings for each row, the address pulses 80 and 81 are applied to the address electrode A in accordance with the application of the scan pulse, and an address discharge is caused to occur in a cell at a point of intersection of the Y electrode and the address electrode. In general, an address pulse is applied to a cell to be lit and no address pulse is applied to a cell not to be lit, therefore, no address discharge is caused therein. When an address discharge is caused, a discharge is caused to occur between the Y electrode to which a scan pulse has been applied and the X electrode to which a selection voltage is being applied and wall charges are formed in the vicinity of the X electrode and the Y electrode in the lit cell.

The sustain pulses are composed of the initial sustain pulses 44, 54, 64, and 74, the sustain pulses 45 and 55 for matching the polarities of wall charges to each other, the first sustain pulses 46, 47, 56, 57, 65, 66, 75, and 76, and the second sustain pulses 46, 47, 56, 57, 65, 66, 75, and 76. The first and second sustain pulses are the first and second sustain waveform pulses, respectively, and the second sustain waveform has a period three times the period of the first sustain waveform. A sustain discharge caused by the second sustain pulse consumes the same amount of power as that consumed by a sustain discharge caused by the first sustain waveform but the sustain discharge by the second sustain waveform is superior in the efficiency of light emission and has, for example, 1.3 times that of the sustain discharge by the first sustain waveform and accordingly, the luminance by one pulse is higher by a factor of 1.3.

In the even field, the waveforms applied to the X1 electrode and the X2 electrode are switched and the waveforms applied to the Y1 electrode and the Y2 electrode are switched.

A discharge by the drive waveform shown in FIG. 6 is explained below.

At the beginning of the reset period, the X erasure dull waves 40 and 60 to be applied to the X electrode and the Y erasure voltages 50 and 70 to be applied to the Y electrode cause a slight discharge to occur repeatedly only in the cells in which a sustain discharge has been caused to occur in the immediately previous subfield and thereby wall charges in the cells are reduced. In this case, in the cells in which a sustain discharge has been caused to occur in the immediately previous subfield, negative wall charges are formed in the vicinity of the X electrode and positive wall charges are formed in the vicinity of the Y electrode, and the voltage due to these wall charges is added to the voltage to be applied and an erasure discharge is caused to occur. Therefore, no erasure discharge is caused to occur in a cell in which no sustain discharge has been caused to occur in the immediately previous subfield and no wall charges are formed. The present embodiment shows a case of an erasure of charges using dull waves, but there may be an erasure using wide rectangular waves having a low voltage (a wide-width erasure) or a narrow line erasure using narrow pulses without forming wall charges.

Next, the Y write dull waves 51 and 71 to be applied to the Y electrode and the X voltages 41 and 61 to be applied to the X electrode cause a slight discharge to occur repeatedly between the X electrode and the Y electrode to form wall charges in a cell. In this case, as the potential difference between the X electrode and the Y electrode is sufficiently large, this charge is caused to occur in all the cells and negative wall charges are formed in the vicinity of the Y electrode and positive wall charges are formed in the vicinity of the X electrode in all the cells.

Further, the Y compensation dull waves 52 and 72 to be applied to the Y electrode, the X compensation voltages 42 and 62 to be applied to the X electrode, and the wall charges produce a potential difference, cause a slight discharge to occur repeatedly between the X electrode and the Y electrode, and reduce the wall charges formed in all the cells so that only a required amount of charges remains. In this case, the potential the Y compensation dull waves 52 and 72 reach is lower than the potential of the scan pulses 53 and 73 and the voltage due to the remaining charges is added to the voltage to be applied to cause an address discharge to occur, that is, the charges serve to cause an address discharge to occur without fail.

The next address period is divided into the first half and the second half. In the first half, in a state in which the selection voltage 43 is being applied to the odd-numbered X electrode X1 and 0 V is being applied to the even-numbered X electrode X2 and Y electrode Y2, the scan pulse 53 is applied to the odd-numbered Y electrode Y1 while the application positions are changed sequentially. The scan pulse 53 is a pulse with a negative part having a still greater absolute value and applied while the application positions are changed sequentially in a state in which a negative voltage is being applied to all the odd-numbered Y electrodes Y1. In synchronization with the application of the scan pulse 53, the address pulse 80 is applied to the address electrode. The address pulse 80 is applied when a cell corresponding to a crossing with the Y electrode to which the scan pulse has been applied is lit, and not applied when the cell is not lit. At this time, the polarity of the wall charges formed during the reset period is identical to the polarity of the pulse to be applied to each of the Y and address electrodes and, therefore, the applied voltage can be lowered thanks to the wall charges. Due to this, an address discharge is caused to occur in a cell to which the selection voltage 43, the scan pulse 53, and the address pulse 80 have been applied simultaneously. This discharge forms wall charges having the negative polarity in the vicinity of the X discharge electrode and wall charges having the positive polarity in the vicinity of the Y discharge electrode. In other words, the cells to be lit are selected in the display line between the odd-numbered X electrode X1 and the odd-numbered Y electrode Y1. By the way, the wall charges at the completion of the reset period are maintained in the vicinity of the even-numbered X electrode to which the selection pulse 43 is not applied and in the vicinity of the even-numbered Y electrode to which the scan pulse 53 is not applied.

The time width of the scan pulse is set to, normally, 1 to 2 μs and, in most cases, 1.5 to 2 μs. There is a time lag before an address discharge is actually caused to occur after the voltage is applied and the scan pulse width is set, this time lag relating to the discharge being taken into account. Moreover, the time lag relating to the discharge is affected by the relative potential between two electrodes between which a discharge is caused to occur, therefore, the relative potential between two electrodes formed by the address pulse and the scan pulse is set so as to cause a discharge to occur with the above-mentioned scan pulse width. A large electric field is formed between the X electrode to which the selection voltage is being applied and the Y electrode to which the scan pulse has been applied and a discharge is caused to occur between the Y electrode and the X electrode induced by the address discharge between the Y electrode and the address electrode. Due to this discharge, wall charges having the opposite polarity to that of the voltage being applied to the above-mentioned electrode are formed in the vicinity of the Y electrode and the X electrode.

In the second half of the address period, in a state in which the selection voltage 63 is being applied to the even-numbered X electrode X2 and 0 V is being applied to the odd-numbered X electrode X1 and Y electrode Y1, the scan pulse 73 is applied to the even-numbered Y electrode Y2 while the application positions are changed sequentially and the address pulse 81 is applied to the address electrode. Due to this, similar to the above, the cells to be lit are selected in the display line between the even-numbered X electrode X2 and the even-numbered Y electrode Y2. Therefore, in the first half and the second half of the address period, an address discharge is caused to occur in the cells to be lit in odd-numbered display lines, and thus the cells to be lit are selected.

During the sustain period, by using the wall charges formed in a cell in which an address discharge has been caused to occur between the odd-numbered X1 electrode and Y1 electrode, the initial sustain pulses 44 and 54 cause an initial discharge to occur in odd-numbered display lines in the odd display lines. Due to this discharge, negative wall charges are formed in the vicinity of the Y1 electrode and positive wall charges are formed in the vicinity of the X1 electrode in a cell in which a discharge has been caused to occur. Next, by using the wall charges formed in a cell in which an address discharge has been caused to occur between the even-numbered X2 electrode and Y2 electrode, the initial sustain pulses 64 and 74 cause an initial discharge to occur in even-numbered display lines in the odd display lines. Due to this discharge, negative wall charges are formed in the vicinity of the Y2 electrode and positive wall charges are formed in the vicinity of the X2 electrode in a cell in which a discharge has been caused to occur. Here, the discharge timing is made to differ between the odd-numbered lines and the even-numbered lines in the odd display lines in order to prevent a discharge from being caused to occur between the X2 electrode and the Y1 electrode.

Similarly, in order to prevent a discharge from being caused to occur between the X2 electrode and the Y1 electrode in the case of the first sustain waveform, it is necessary to apply a sustain pulse having the same polarity to the neighboring electrode with which no discharge is caused to occur. Therefore, after the initial sustain pulse, it is necessary to reverse the polarity of the wall charges to be formed in either the odd-numbered or the even-numbered display line in the odd display lines. Therefore, positive wall charges are formed in the vicinity of the Y1 electrode and negative wall charges are formed in the vicinity of the X1 electrode by applying the sustain pulses 45 and 55 for matching the polarity of the wall charges of the X1 electrode with that of the Y1 electrode. Due to this, the polarities of the wall charges formed in the cells in the odd-numbered and even-numbered display lines in the odd display lines are opposite to each other.

Next, by repeating the application of the first sustain pulses 46, 47, 56, 57, 65, 67, 75, and 76 having the first sustain waveform, the first sustain discharge is caused to occur repeatedly in the cells to be lit in both the odd-numbered and the even-numbered display lines in the odd display lines. Moreover, by repeating the application of the first sustain pulses 48, 49, 58, 59, 67, 68, 77, and 78 having the second sustain waveform, the second sustain discharge is caused to occur repeatedly in the cells to be lit in both the odd-numbered and the even-numbered display lines in the odd display lines.

As described above, there may be a case where only the first sustain pulse is applied and the second sustain pulse is not, and a case where only the second sustain pulse is applied and the first sustain pulse is not.

In the even-numbered display line in the odd display lines, the number of sustain discharges is one less than the odd-numbered display line, which sustain discharge is caused to occur by polarity matching pulses 45 and 56, therefore, after the second sustain pulse is applied, a sustain pulse is applied to the even-numbered display line in order to adjust the number of discharges. Due to the sustain discharge for adjusting the number of discharges, wall charges having the same polarity are formed in the vicinity of the X electrode and the Y electrode, respectively, in all the cells in the odd display lines in which a discharge has been caused to occur, therefore, it is possible to reduce the wall charges in the above-mentioned reset period by applying the common erasure voltage and erasure dull wave to all the X and Y electrodes.

A description of the even field is not given here.

The general configuration of the ALIS system PDP apparatus used in the first embodiment of the present invention is described as above.

Next, the power control (the control of the number of sustain pulses) in the PDP apparatus in the first embodiment is explained below.

Figures 1A, 1B:
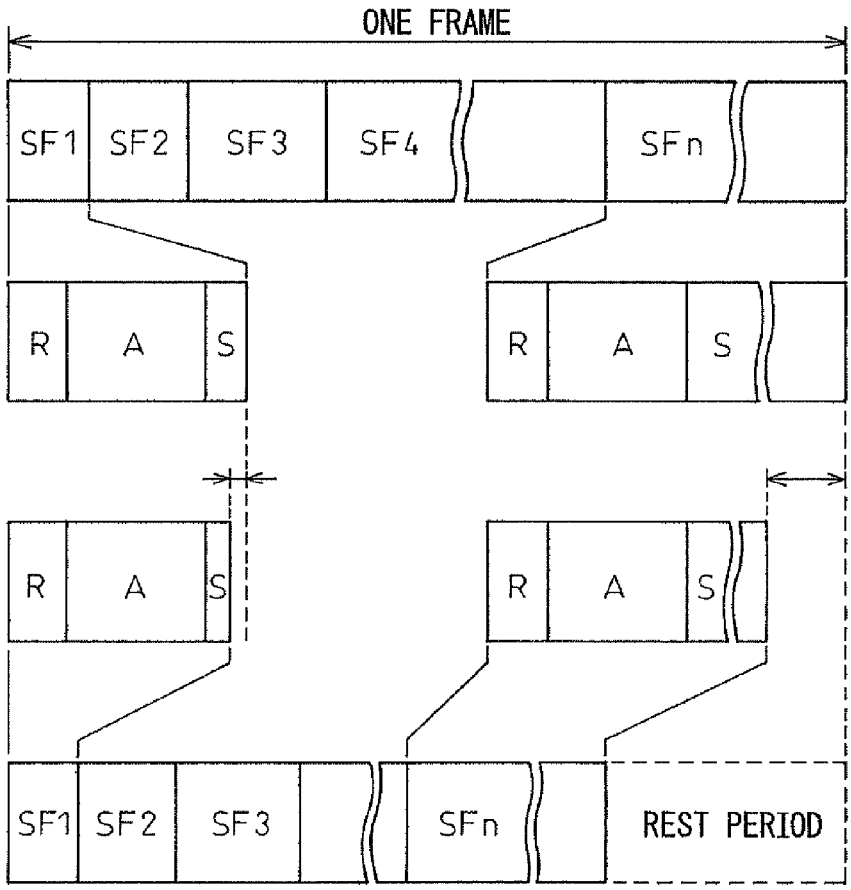
FIG. 1A and FIG. 1B are diagrams for explaining a conventional subfield configuration.
Figure 2A:
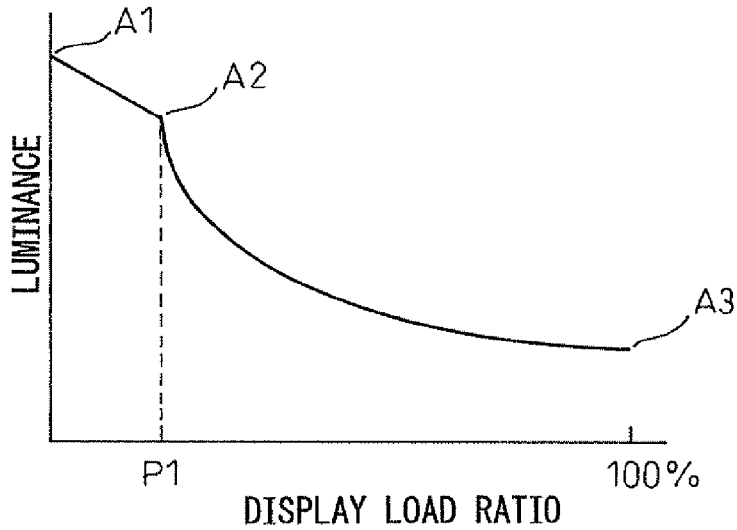
FIG. 2A to FIG. 2C are diagrams for explaining a conventional power control.
Figure 2B:
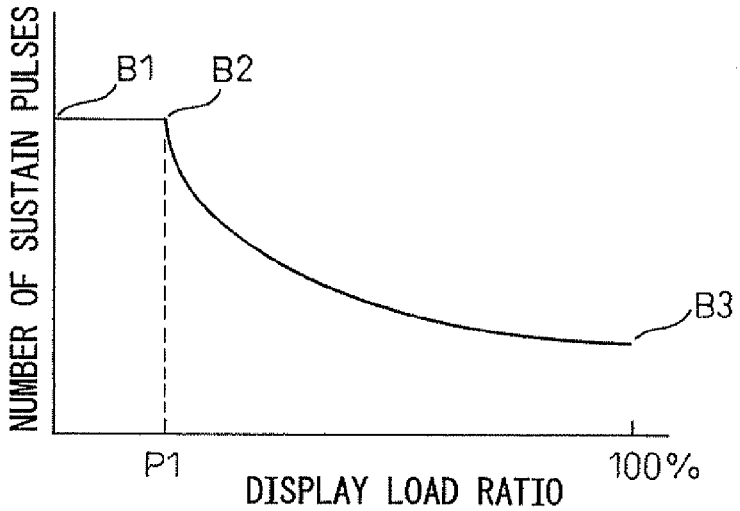
Figure 2C:
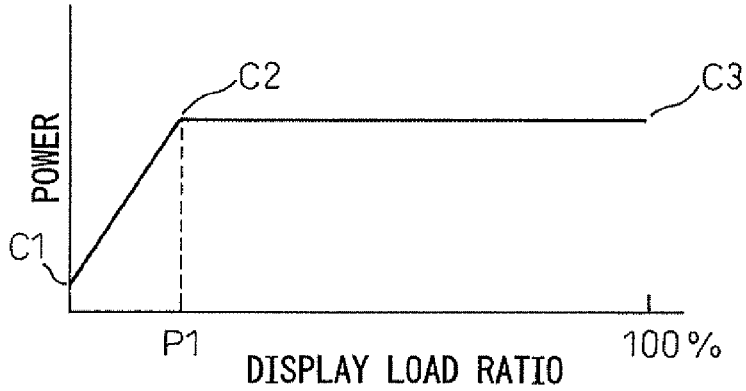
Figure 7A:
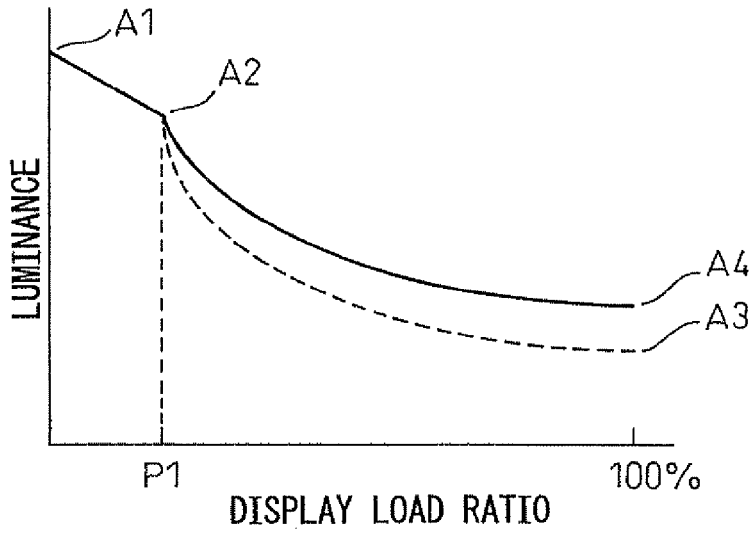
FIG. 7A to FIG. 7C are diagrams for explaining a power control in the first embodiment.
Figure 7B:
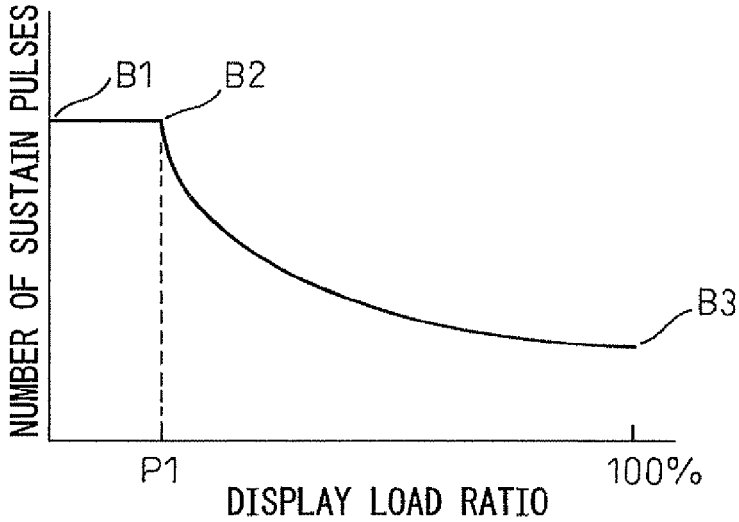
Figure 7C:
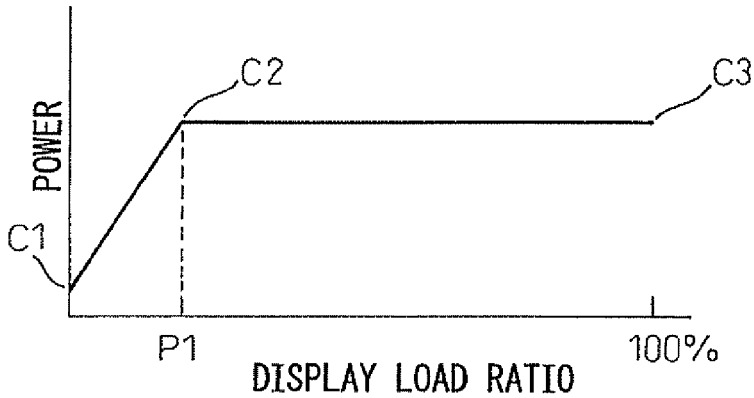

FIG. 7A to FIG. 7C are diagrams for explaining the power control in the first embodiment, corresponding to FIG. 2A to FIG. 2C for conventional examples, respectively. FIG. 7A shows a relationship between display load ratio and luminance, FIG. 7B shows a relationship between display load ratio and the number of sustain pulses, and FIG. 7C shows a relationship between display load ratio and power. In the domain where the display load ratio is less than P1, the power is equal to or less than a predetermined value, which is an upper limit, similar to the conventional cases, therefore, the number of sustain pulses is kept to a constant value as shown in FIG. 7B (B1-B2). FIG. 5B shows the subfield configuration in this domain and the sustain period S is composed of only the sustain period S1 during which the first sustain waveform is used. In this domain, as the display load ratio increases, the current of the sustain discharge in the circuit and panel increases, the luminance gradually decreases because of a drop in voltage etc. (A1-A2), and the power increases (C1-C2).

In the domain where the display load ratio is greater than P1, the power control (the control of the number of sustain pulses) is carried out to deduce the number of sustain pulses in accordance with the display load ratio as shown in FIG. 7B (B2-B2), and the control is carried out so that the power is kept to a predetermined value as shown in FIG. 7C (C2-C3). As the number of sustain pulses decreases, a rest period is produced and when the length of the reset period becomes equal to the length of two of the first sustain pulses, one of the first sustain pulses in any one of the subfields is replaced with the second sustain pulse having the second sustain waveform. After this, in accordance with the length of the rest period, the number of first sustain pulses to be replaced with the second sustain pulse is increased sequentially. FIG. 5C and FIG. 5D show a state in which the first sustain pulse is replaced with the second sustain pulse.

Specifically, in this control, the rest period is first calculated similar to the conventional power control. It is assumed that the second sustain waveform has a period three times the period, and a luminance 1.3 times the luminance, of the first sustain waveform. First, the rest period is divided by the difference in period between the second sustain waveform and the first sustain waveform (in this embodiment, twice the period of the first sustain waveform). The result of the division means the number of sustain pulses that can be replaced with the second sustain waveform in this frame (the number of replaced pulses). The value obtained by subtracting the number of replaced pulses from the number of sustain pulses in one frame (the total number of sustain pulses) is the number of pulses having the first sustain waveform to be used in this frame (the number of remaining pulses). Next, the luminance is calculated and in accordance with the luminance ratio, the luminance to be allocated to each subfield is calculated. Then, the second sustain pulses are distributed to each subfield so that the difference between the luminance of each subfield thus allocated and the luminance when the pulse is actually replaced with another one is as small as possible. Specifically, when the members of the luminance ratio among eight subfields are 1, 2, 4, 8, 16, 32, 64, and 128, that is, the total luminance is 256, and if the number of first sustain pulses decreases by six, the number of replaced pulses is 6/2, that is, three. Therefore, the total luminance value is $256-3+3\times1.3=256.9$. If this total luminance value is distributed without changing the luminance ratio, the members are approximately 1, 2, 4, 8, 16.1, 32.1, 64.2, and 128.5. If the three pulses to be replaced are distributed so that the ratio is most approximate to the above-mentioned ratio, two of the pulses are distributed to the subfield having a member of 128 and one of the pulses is distributed to the subfield having a member of 64 and as a result, the members in the luminance ratio are 1, 2, 4, 8, 16, 32, 64.3, and 128.6 and the difference between luminance ratios can be reduced. It is preferable to perform this replacement all together at the rear part in each subfield. By replacing the first sustain waveform with the second sustain waveform as described above, the power control is carried out so as to increase the luminance while the luminance ratio among subfields is maintained, the continuity of gradations is not lost by replacement, and a rest period is not produced.

By carrying out the control described above, one of the first sustain pulses having the first sustain waveform is sequentially replaced with one having the second sustain waveform when replacement can be done and, therefore, the luminance changes smoothly. Actually, because of decimal fractions that cannot be replaced, there exists a rest period having a length of between 0 and twice the period of the first sustain waveform and, therefore, the luminance changes in a somewhat stepwise manner, but this can be ignored. Moreover, because of errors produced when decimal fractions are rounded down to obtain the equivalent number of pulses, errors are produced in the luminance ratio, but this can also be ignored.

Either way, in the domain where the display load ratio is equal to or greater than P1, the sustain pulses in the same number as that in the conventional examples are applied but, as the sustain pulse having the second sustain waveform with an excellent light emission efficiency is used at least partly, the luminance that changes from A2 to A4 is, as shown in FIG. 7, higher than the conventional luminance that changes from A2 to A3 as shown is FIG. 2A to FIG. 2C.

Moreover, even if the number of sustain pulses decreases, no rest period is produced and, therefore, flickers do not increase in number because the periods of light emission are unlikely to gather at the front in a frame as in the conventional examples.

In the first embodiment, it is assumed that the second sustain waveform has a period three times the period of the first sustain waveform, the sustain discharge caused by the second sustain pulse consumes the same power as that the sustain discharge caused by the first sustain pulse consumes, but the second sustain waveform has a light emission efficiency 1.3 times that of the first sustain waveform, and therefore, the luminance is also higher by a factor of 1.3. However, this is just an example, and there may be a variety of relationships therebetween because the two pulses can have difference characteristics depending on waveforms. Either way, it is necessary to prevent the power from exceeding the upper limit and the display luminance from changing. Variation examples of the control under various conditions are explained below.

Figure 8A:
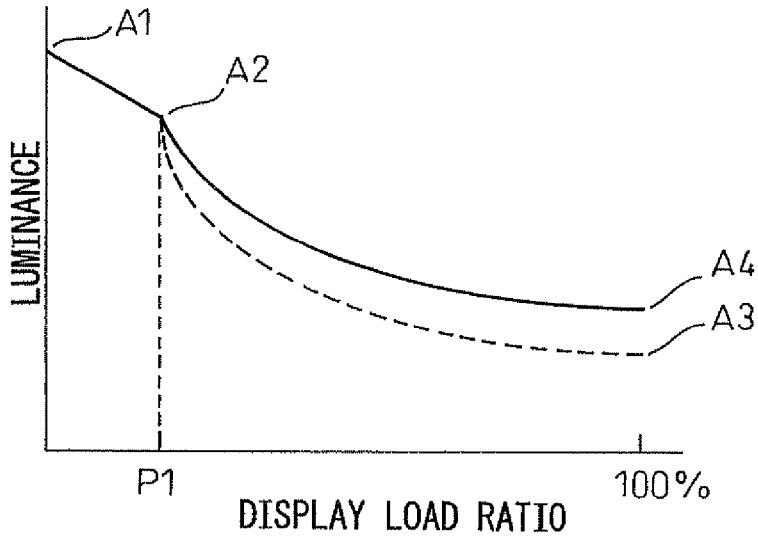
FIG. 8A to FIG. 8C are diagrams for explaining a first variation example of the power control.
Figure 8B:
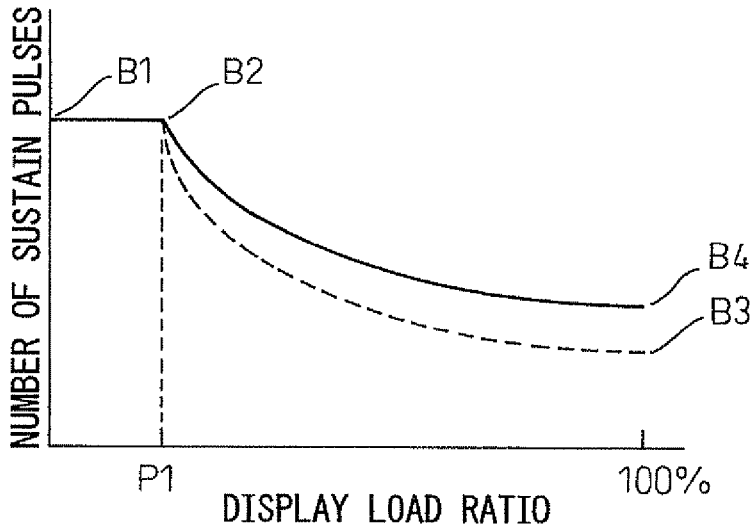
Figure 8C:
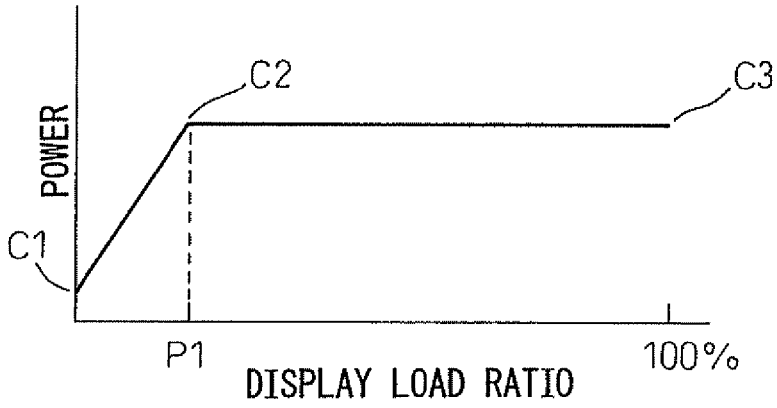

FIG. 8A to FIG. 8C are diagrams for explaining a power control when the second sustain waveform has a period three times the period of the first sustain waveform, the sustain discharge caused by the second sustain pulse has the same light emission efficiency as that of the sustain discharge caused by the first sustain pulse, and accordingly, the luminance by one pulse is the same but less power is consumed by the sustain discharge caused by the second sustain pulse than that by the first sustain pulse. FIG. 8A to FIG. 8C correspond to FIG. 7A to FIG. 7C, respectively, and FIG. 8A shows a relationship between display load ratio and luminance, FIG. 8B shows a relationship between display load ratio and the number of sustain pulses, and FIG. 8C shows a relationship between display load ratio and power.

When the display load ratio is equal to or less than P1, the control is the same as that in the conventional examples and in the first embodiment, that is, the number of sustain pulses is kept to a constant value (B1-B2) as shown in FIG. 8B, the power increases gradually as shown in FIG. 8C, and the luminance decreases gradually as shown in FIG. 8A. When the display load ratio exceeds P1, the number of sustain pulses is reduced in accordance with the display load ratio in order to keep the power below the upper limit and a rest period is produced as a result. The number of pulses that can be replaced with the first sustain pulse (the number of replaced pulses) is obtained by dividing the length of the rest period by a period twice that of the first sustain pulse. As described above, by the use of the second sustain pulse instead of the first sustain pulse, the power to be consumed can be reduced, therefore, the number of sustain pulses can be increased accordingly. At this time, the number of second sustain pulses is increased as much as possible, but when there are decimal fractions, the number of first sustain pulses is increased.

Either way, the number of sustain pulses (the total number of first and second sustain pulses) increases compared to the conventional examples and the first embodiment, as shown in FIG. 8B. Moreover, as the number of sustain pulses increases, the luminance increases (A2-A4) compared to the conventional examples, as shown in FIG. 8A. As the luminance by the first and second sustain pulses is the same, the allocation of sustain pulses to each subfield can be carried out conventionally. However, as described above, there is the possibility that the luminance ratio between the first and second sustain waveforms may change, it is preferable to make the first and second sustain waveforms coexist in as many subfields as possible.

As described above, in a first variation example of a power control shown in FIG. 8, the proportion of the second sustain pulses to be used is gradually increased as the number of sustain pulses decreases and, therefore, the luminance changes smoothly.

Figure 9A:
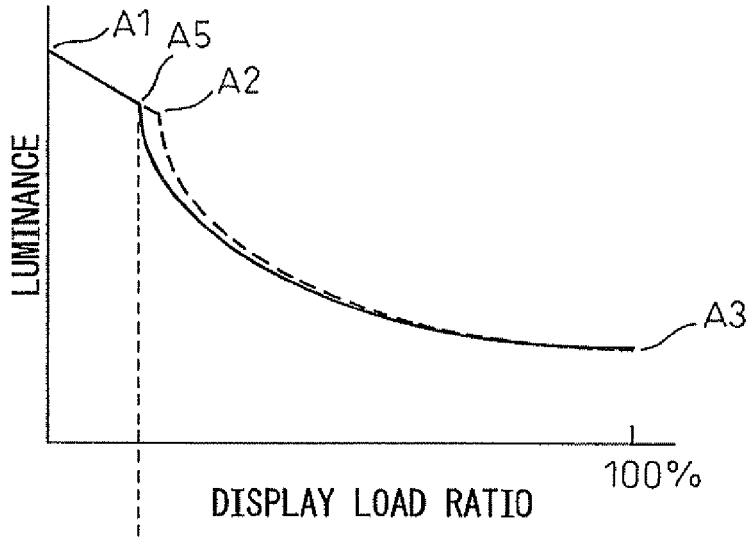
FIG. 9A to FIG. 9C are diagrams for explaining a second variation example of the power control.
Figure 9B:
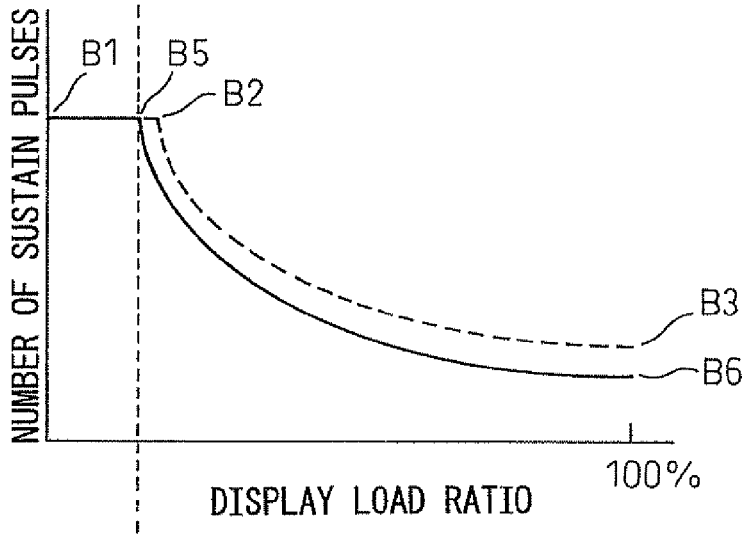
Figure 9C:
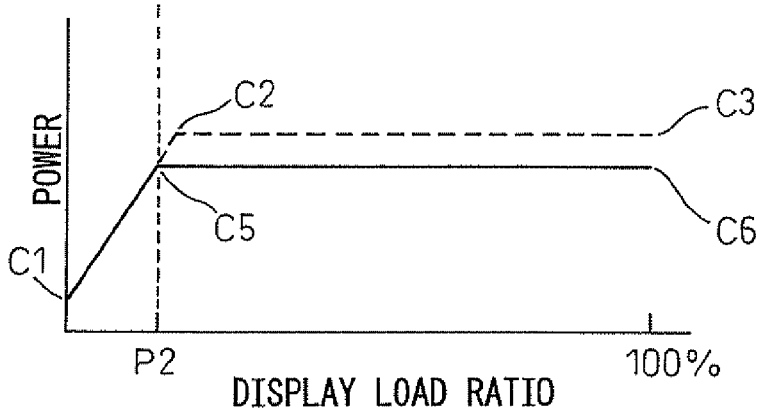

FIG. 9A to FIG. 9C are diagrams for explaining a power control in a second variation example when, as in the first embodiment, the second sustain waveform has a period three times the period of the first sustain waveform, the sustain discharge caused by the second sustain pulse consumes the same power as that the sustain discharge caused by the first sustain pulse consumes, but the light emission efficiency and the luminance are higher, and the purpose there of is to reduce power consumption. In the power control in the second variation example, the control is carried out so that the luminance when the display load ratio is 100% is the same as A3 as before. FIG. 9A to FIG. 9C correspond to FIG. 7A to FIG. 7C, respectively, and FIG. 9A shows a relationship between display load ratio and luminance, FIG. 9B shows a relationship between display load ratio and the number of sustain pulses, and FIG. 9C shows a relationship between display load ratio and power.

In this case, the second sustain pulse is used when the display load ratio is 100% and the number of sustain pulses can be reduced from B3 to B6 as the luminance increases as shown in FIG. 9B. Moreover, in accordance with the reduction of the number of sustain pulses from B3 to B6, the power decreases from C3 to C6. This value is taken as an upper limit.

After this, as in the first embodiment, power control is carried out while taking the above-mentioned value as an upper limit of power. Specifically, when the display load ratio is equal to or less than P2, the number of sustain pulses is kept to a constant value (B1-B5) as shown in FIG. 9B, the power increases gradually up to the above-mentioned upper limit as shown in FIG. 9C (C1-C5), and the luminance decreases gradually as shown in FIG. 9A (A1-A5). When the display load ratio exceeds P2, the number of sustain pulses is reduced in accordance with the display load ratio so that the power is kept below the upper limit (C5-C6). Then, the number of second sustain pulses to be used in accordance with the reduction in the number of sustain pulses is increased gradually, as shown in FIG. 9B. Due to this, the reduction in luminance due to the reduction in the number of sustain pulses is slowed down and the luminance changes as shown in FIG. 9A (A5-A3).

As described above, in the second variation example of the power control shown in FIG. 9A to FIG. 9C, the proportion of the second sustain pulses to be used is increased in accordance with the reduction in the number of sustain pulses and, therefore, the luminance changes smoothly.

Figure 10A:
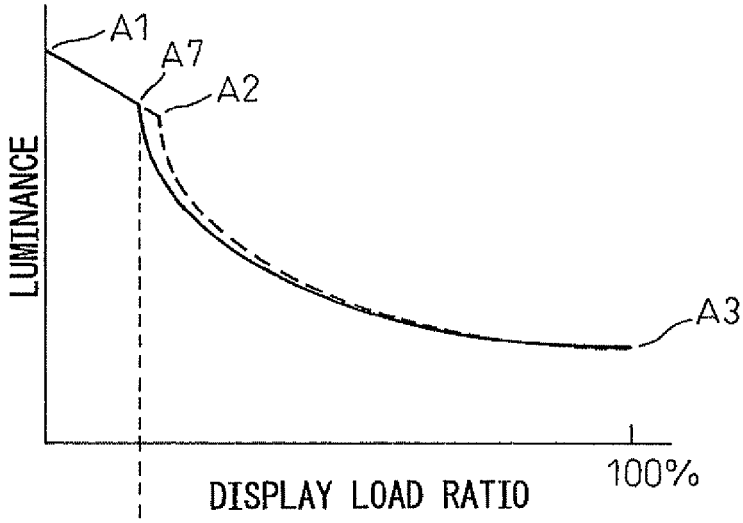
FIG. 10A to FIG. 10C are diagrams for explaining a third variation example of the power control.
Figure 10B:
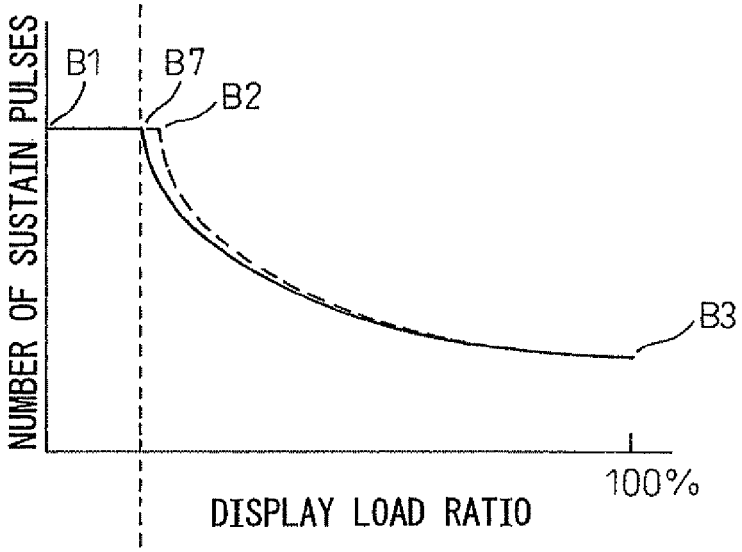
Figure 10C:
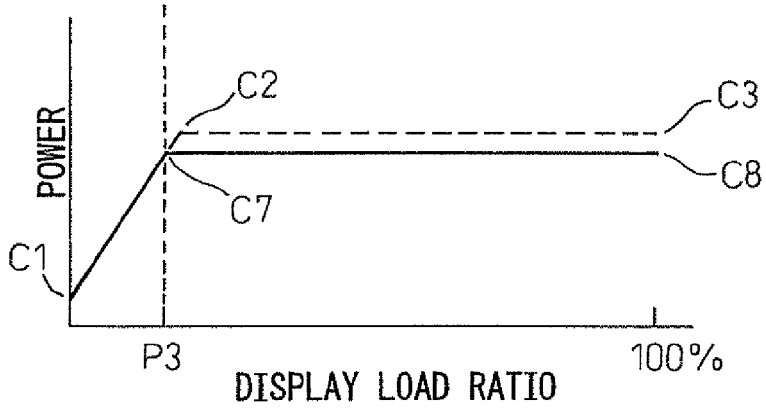

FIG. 10A to FIG. 10C are diagrams for explaining a power control in a third variation example when, as in the power control in the first variation example, the second sustain waveform has a period three times the period of the first sustain waveform, the sustain discharge caused by the second sustain pulse has the same light emission efficiency as that of the sustain discharge caused by the first sustain pulse and, accordingly, the luminance by one pulse is the same but power is less, and the purpose is to reduce power consumption. FIG. 10A to FIG. 10C also correspond to FIG. 7A to FIG. 7C, respectively, and FIG. 10A shows a relationship between display load ratio and luminance, FIG. 10B shows a relationship between display load ratio and the number of sustain pulses, and FIG. 10C shows a relationship between display load ratio and power.

In the third variation example, as in the second variation example, the control is carried out so that the luminance when the display load ratio is 100% is the same as A3 as before. As shown in FIG. 10B, when the display load ratio is 100%, the number of sustain pulses is B3 as before, but as the second sustain pulse is used, the power is reduced from C3 to C8. This value is taken as an upper limit.

After this, similar to the embodiment described above, the power is controlled while taking the above-mentioned value as an upper limit. Specifically, when the display load ratio is equal to or less than P3, the number of sustain pulses is kept to a constant value as shown in FIG. 10B (B1-B7), the power increases gradually up to the upper limit as shown in FIG. 10C (C1-C7), and the luminance decreases gradually as shown in FIG. 10A (A1-A7). When the display load ratio exceeds P3, the power is kept below the upper limit as shown in FIG. 10C (C7-C8), and the number of sustain pulses is decreased in accordance with the display load ratio as shown in FIG. 10B (B7-B3). Then, the second sustain pulses to be used are gradually increased in number as the number of sustain pulses decreases. Due to this, as shown in FIG. 10A, the luminance decreases somewhat compared to the conventional luminance with a large power (A2-A3), but the amount of decrease is small and becomes smaller as the display load ratio increases, and the same luminance can be obtained when the display load ratio is 100% and the power can be reduced.

As described above, in the third variation example of the power control shown in FIG. 10A to FIG. 10C, the proportion of the second sustain pulses to be used is increased as the number of sustain pulses decreases, therefore, the luminance changes smoothly.

In the first embodiment and variation examples, the second sustain waveform has a period longer than that of the first sustain waveform but both have the same rectangular shape. When the electrode of the panel is driven, because of the capacity of the electrode and the drive performance of the drive circuit, the frequency responsibility is not sufficient, and the period of the first sustain waveform is short, therefore, a complex waveform cannot be applied. As a result, the rectangular pulse waveform is used. In contrast to this, as the period of the second sustain waveform is long, it is possible to increase the efficiency of light emission using waveforms other than the rectangular waveform. Variations of examples of the second sustain waveform are explained below.

Figure 11A:
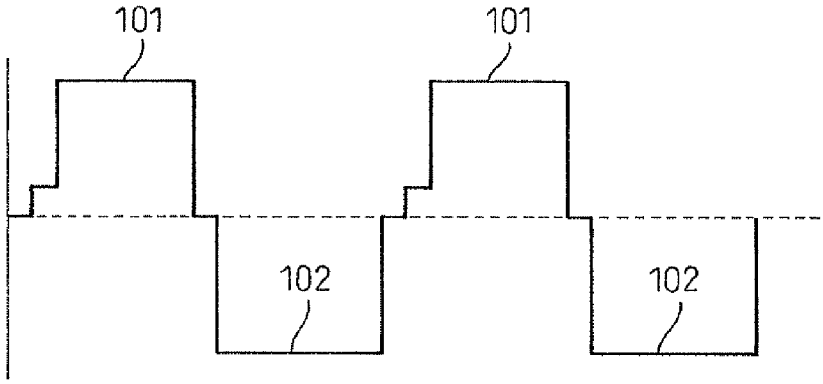
FIG. 11A to FIG. 11C are diagrams showing a first variation example of a second sustain waveform.
Figure 11B:
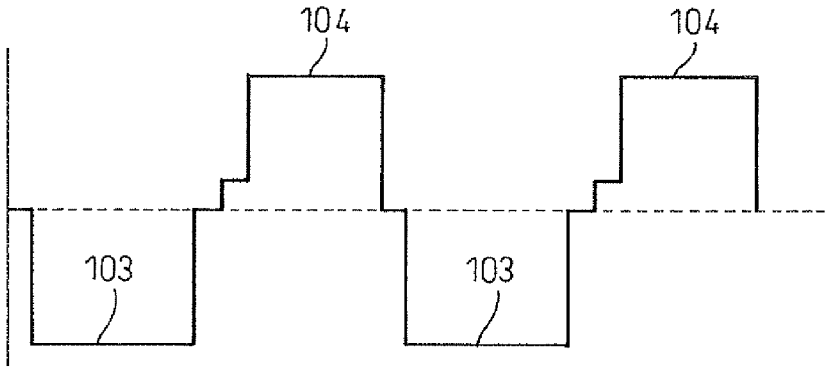
Figure 11C:
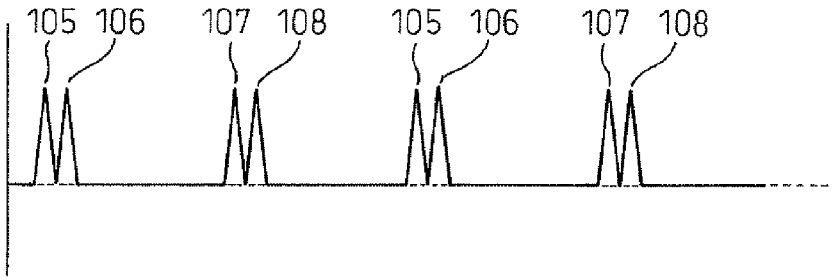

FIG. 11A to FIG. 11C are diagrams showing a first variation example of the second sustain waveform. FIG. 11A and FIG. 11B show sustain pulses to be applied to the X electrode and Y electrode and FIG. 11C shows discharges that occur. In the first variation example, pulses having opposite polarities are alternately applied to the X electrode and Y electrode and the difference in the voltage applied to the X electrode and Y electrode corresponds to a sustain pulse. In this example, at the rise of sustain waveforms 101 and 104, an intermediate low voltage (absolute value) is applied for a short time and two discharges 105 and 106 and two discharges 107 and 108 are caused to occur at the respective edges of change. Due to these discharges, the luminance is increased. In order to cause such a discharge to occur, it is necessary for the period of the sustain pulse to be longer than a certain length.

Figure 12A:
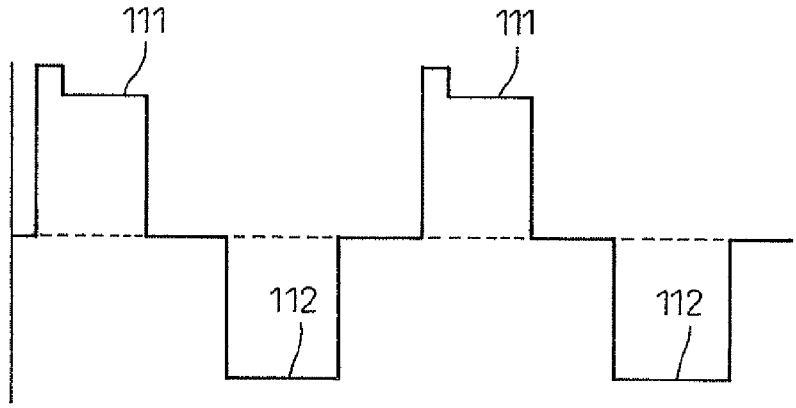
FIG. 12A to FIG. 12C are diagrams showing a second variation example of the second sustain waveform.
Figure 12B:
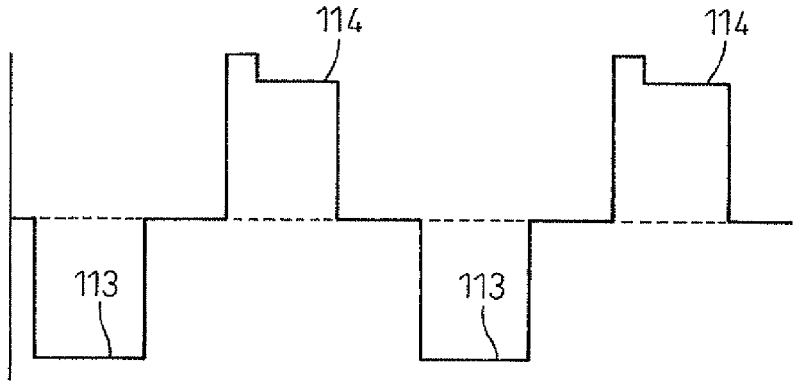
Figure 12C:
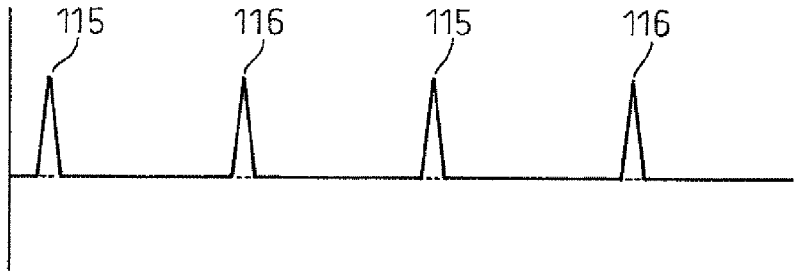

FIG. 12A to FIG. 12C are diagrams showing a second variation example of the second sustain waveform. FIG. 12A and FIG. 12B show sustain pulses to be applied to the X electrode and Y electrode and FIG. 12C shows discharges that occur. In the second variation example also, pulses having the opposite polarities are alternately applied to the X electrode and Y electrode and the difference in the voltage applied to the X electrode and Y electrode corresponds to a sustain pulse. In this example, at the rise of sustain waveforms 111 and 114, after a high voltage is applied for a short time, a state in which a voltage slightly lower than the high voltage is being applied is maintained. The slightly lower voltage is substantially the same level as the voltage used in the conventional cases. Due to these discharges, discharges 115 and 116, the luminance of which has been increased can be obtained, but this variation example cannot be applied to the first sustain waveform because it is necessary to control the discharge timing and lengthen the interval between sustain discharges more than that in the conventional cases.

The power control in which the proportion of the second sustain waveforms to be used is varied gradually is described as above, but such a control needs to use a processing circuit having a complex and high processing function. A plasma display apparatus that performs a more simplified power control is explained below.

Figure 13A:
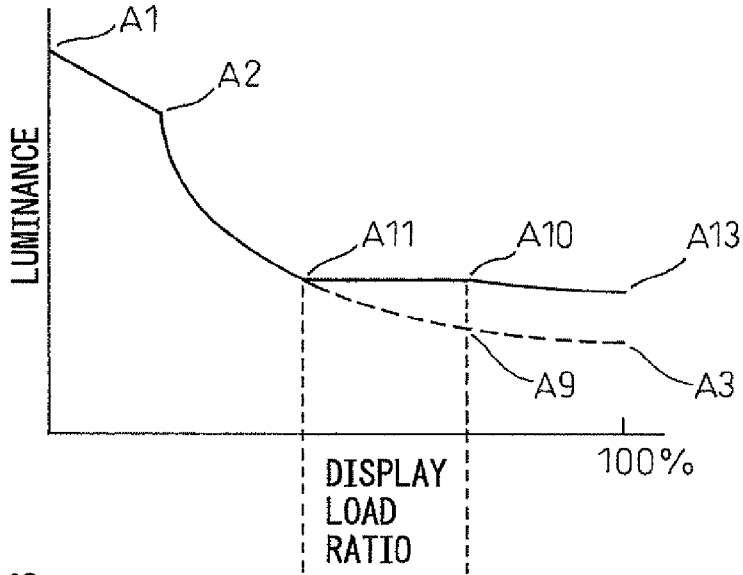
FIG. 13A to FIG. 13C are diagrams for explaining a power control in a PDP apparatus in a second embodiment of the present invention.
Figure 13B:
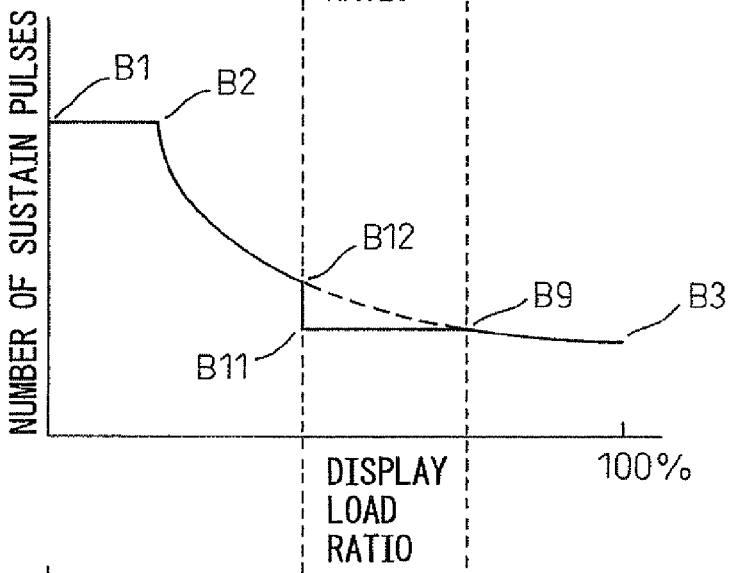
Figure 13C:
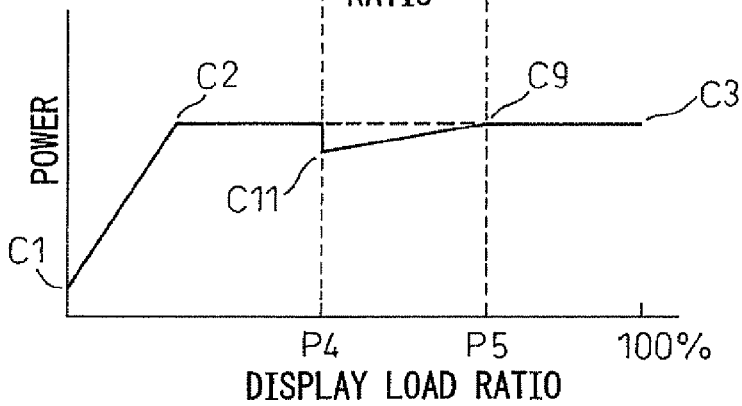

FIG. 13A to FIG. 13C are diagrams for explaining a power control in a plasma display apparatus in a second embodiment of the present invention. FIG. 13A shows a relationship between display load ratio and luminance, FIG. 13B shows a relationship between display load ratio and the number of sustain pulses, and FIG. 13C shows a relationship between display load ratio and power. The second sustain waveform has a period three times the period of the first sustain waveform and the sustain discharge caused by the second sustain pulse consumes the same power as that the sustain discharge caused by the first sustain pulse consumes, but the efficiency of light emission and the luminance are high, and a control is carried out so that the waveforms of all the sustain pulses are changed from the first sustain waveform to the second sustain waveform when the display load ratio is a predetermined P4.

If the waveforms of all the sustain pulses are changed from the first sustain waveforms to the second sustain waveforms when the number of sustain pulses is B9, at which such a replacement can be carried out, the luminance becomes A10. At this time, the display load ratio is P5. The luminance A10 corresponds to the luminance A11 when only the first sustain waveform is used and at this time, the number of sustain pulses is B12 in the case of the first sustain waveform and B11 in the case of the second sustain waveform. At this time, the power is at the upper limit when only the first sustain waveform is used, but is C11 when the second sustain waveform is used, and the display load ratio is P4. A replacement is carried out so that only the first sustain waveform is used until the display load ratio exceeds P4 and after the display load ratio exceeds P4, only the second sustain waveform is used. At this time, the number of sustain pulses changes from B12 to B11 but the luminance does not change. While the display load ratio is between P4 and P5, the number of sustain pulses is constant as B11-B9 and, after dropping to C11, the power increases gradually and reaches the upper limit when the display load ratio is P5. In the meantime, the luminance is constant as A11-A10. When the display load ratio exceeds P5, the power is kept to the upper limit and the number of sustain pulses and the luminance decrease gradually.

As described above, in the power control in the second embodiment shown in FIG. 13A to FIG. 13C, the sustain waveform to be used is changed from the first sustain waveform to the second sustain waveform for all the sustain pulses but the luminance changes smoothly.

Figure 14A:
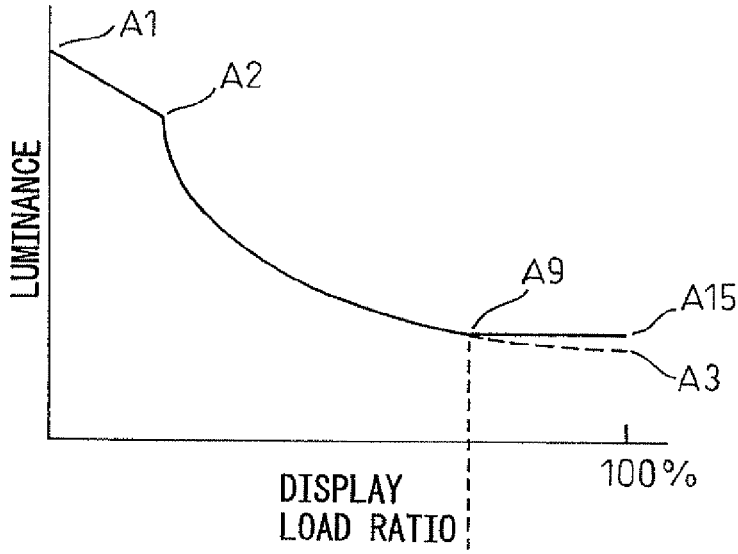
FIG. 14A to FIG. 14C are diagrams for explaining a power control in a PDP apparatus in a third embodiment of the present invention.
Figure 14B:
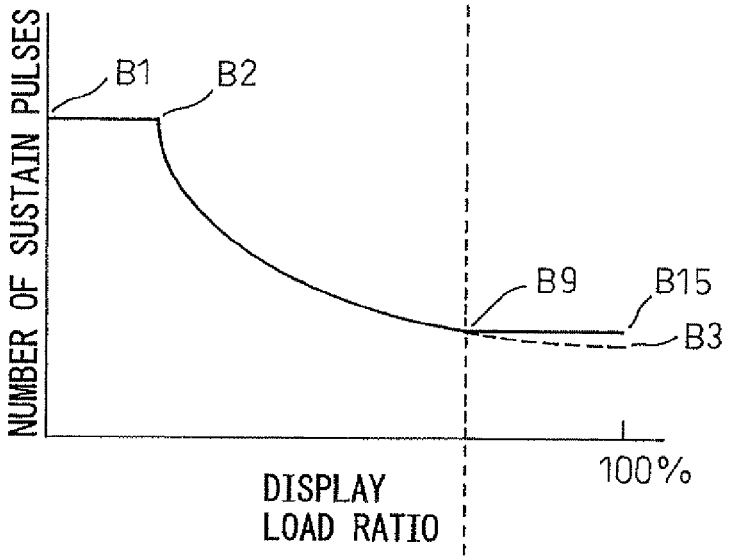
Figure 14C:
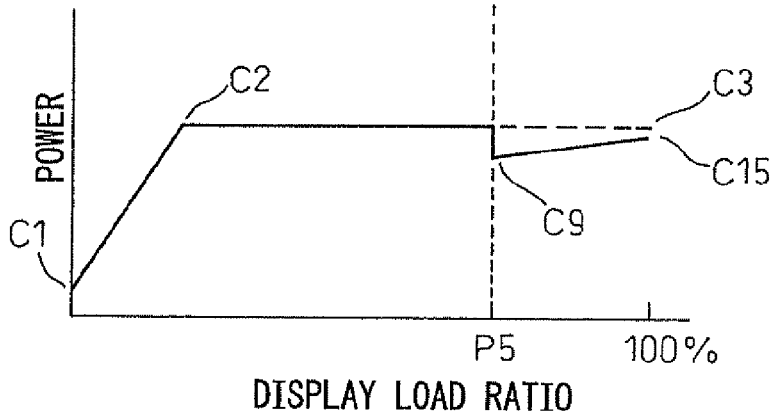

FIG. 14A to FIG. 14C are diagrams for explaining a power control in a plasma display apparatus in a third embodiment of the present invention. FIG. 14A shows a relationship between display load ratio and luminance, FIG. 14B shows a relationship between display load ratio and the number of sustain pulses, and FIG. 14C shows a relationship between display load ratio and power. The second sustain waveform has a period three times the period of the first sustain waveform, the sustain discharge caused by the second sustain pulse has the same efficiency of light emission and the luminance as those of the sustain discharge caused by the first sustain pulse but the power is reduced, and a control is carried out so that the waveforms of all the sustain pulses are changed from the first sustain waveform to the second sustain waveform when the display load ratio is a predetermined P5.

The waveforms of all the sustain pulses are changed from the first sustain waveforms to the second sustain waveforms when the number of sustain pulses is B9, at which such a replacement can be carried out. Even after this replacement, the luminance remains unchanged, that is, A9, but the power decreases from the upper limit to C14. When the display load ratio is equal to or greater than P5, the power increases as the display load ratio increases (C14-C15) but the number of sustain pulses is maintained (B9-B15) and the luminance is also maintained (A9-A15).

As described above, in the power control in the third embodiment shown in FIG. 14A to FIG. 14C, the sustain waveform to be used is changed from the first sustain waveform to the second sustain waveform for all the sustain pulses but the luminance changes smoothly.

By the way, in the second and third embodiments, if the switching point at which the first sustain waveform is changed to the second sustain waveform changes because of variations of the panel or the circuit, the switching point may be adjusted so that the luminance changes smoothly. Moreover, the sustain voltage may be adjusted so that the luminance changes smoothly.

In the embodiments and variation examples described above, either the luminance increases or the power decreases when the second sustain waveform is used compared to when the first sustain waveform is used, but there may be a case where the luminance increases and the power decreases and the present invention can be applied to such a case similarly.

Moreover, in the embodiments and variation examples described above, an example is explained in which the first sustain waveform is replaced with the second sustain waveform, but it is also possible to use the third sustain waveform and further, the fourth sustain waveform.

As described above, according to the present invention, the luminance of a plasma display apparatus can be increased while maintaining an excellent display quality without increasing the consumption power. Due to this, a plasma display apparatus can be realized, which satisfies various requirements such as the number of gradations that can be displayed, the display luminance, and the upper limit of the power, and further, a bright display can be produced and the display quality of which is not deteriorated.

What is claimed is:

1. A driving method of a plasma display apparatus displaying an image by employing plural subfields, wherein said subfield includes a sustain period, the driving method comprising:

applying a first sustain pulse which produces a one time discharge during a rising thereof, and a second sustain pulse, which has a pulse width wider than said first sustain pulse and produces a two times discharge during the rising thereof by applying a first voltage and thereafter applying a second voltage higher than the first voltage, during said sustain period;

increasing a ratio of replacing said first sustain pulse with said second sustain pulse, as a display load factor of said image is increased and a total sustain pulse number is decreased, in a subfield having a sustain period in which said first and/or second sustain pulses are applied repeatedly; and controlling to determine a replacement number of the first sustain pulses which are replaced with the second sustain pulse in each subfield, according to an available number of the first sustain pulses which can be replaced with the second sustain pulse in a frame, and a luminance ratio of the plurality of subfields in the frame.

2. The driving method of a plasma display apparatus of claim 1, wherein the ratio of replacing said first sustain pulse with said second sustain pulse is different between said subfields.

3. The driving method of a plasma display apparatus of claim 1, wherein when said display load factor of said image is greater than a predetermined value, all of the sustain pulses repeatedly applied in said sustain period are replaced with the second sustain pulse.

4. The driving method of the plasma display apparatus of claim 1, wherein a period for applying the first voltage is shorter than a period for applying the second voltage, and the two times discharges are produced continuously.

5. The driving method of the plasma display apparatus of claim 1, wherein when the display load factor of said image is less than a first value at which power becomes an upper level in a region of the display load factor in which a number of the sustain pulses is controlled to be constant according to a power control, the sustain pulses repeatedly applied during the sustain period are all the first sustain pulses without any being replaced by the second sustain pulse.

6. The driving method of the plasma display apparatus of claim 1, wherein at least one of luminance and efficiency of light emission during the second sustain pulse is larger than during the first sustain pulse.

* * * * *

UNITED STATES PATENT AND TRADEMARK OFFICE

CERTIFICATE OF CORRECTION

PATENT NO. : 8,094,093 B2
APPLICATION NO. : 12/175418
DATED : January 10, 2012
INVENTOR(S) : Takashi Sasaki et al.

It is certified that error appears in the above-identified patent and that said Letters Patent is hereby corrected as shown below:

In the Claims:

Column 18, Line 34, In Claim 2, delete “a” and insert -- the --, therefor.

Column 18, Line 38, In Claim 3, delete “a” and insert -- the --, therefor.

Signed and Sealed this
Seventeenth Day of April, 2012

David J. Kappos

David J. Kappos
*Director of the United States Patent and Trademark Office*